US007293618B2

(12) United States Patent
Belik

(10) Patent No.: US 7,293,618 B2
(45) Date of Patent: Nov. 13, 2007

(54) POWER SLIP FOR DRILLPIPE

(75) Inventor: Jaroslav V. Belik, Pearland, TX (US)

(73) Assignee: National-Oilwell, L.P., Houston, TX (US)

( * ) Notice: Subject to any disclaimer, the term of this patent is extended or adjusted under 35 U.S.C. 154(b) by 221 days.

(21) Appl. No.: 10/799,511

(22) Filed: Mar. 12, 2004

(65) Prior Publication Data

US 2005/0199397 A1 Sep. 15, 2005

(51) Int. Cl.
*E21B 19/10* (2006.01)

(52) U.S. Cl. ..... 175/423; 166/77.53; 166/382; 166/78.1

(58) Field of Classification Search ..... 175/423; 166/380, 77.53, 85.1, 78.1, 382; 294/102.1, 294/102.2; 267/125; 188/28, 31, 43, 44, 188/67, 119, 126, 129, 136, 139, 185, 188
See application file for complete search history.

(56) References Cited

U.S. PATENT DOCUMENTS

| | | | | | |
|---|---|---|---|---|---|
| 1,552,062 | A | * | 9/1925 | Krell | 188/67 |
| 1,889,592 | A | * | 11/1932 | Brandt | 188/67 |
| 2,030,087 | A | | 2/1936 | Young et al. | 294/90 |
| 2,340,597 | A | * | 2/1944 | Kelley | 188/67 |
| 2,545,627 | A | * | 3/1951 | Moore | 188/67 |
| 2,575,649 | A | * | 11/1951 | Abegg | 188/67 |
| 2,594,446 | A | * | 4/1952 | Kelley | 188/67 |
| 2,641,816 | A | | 6/1953 | Liljestrand | 24/263 |
| 2,736,941 | A | * | 3/1956 | Mullinix | 188/67 |
| 3,760,469 | A | | 9/1973 | Brown | 24/263 |
| 4,253,219 | A | | 3/1981 | Krasnov | 24/263 |
| 4,269,277 | A | * | 5/1981 | Baugh | 173/149 |
| 4,450,606 | A | * | 5/1984 | Broussard | 188/67 |
| 4,480,703 | A | * | 11/1984 | Garrett | 175/195 |
| 4,715,456 | A | * | 12/1987 | Poe et al. | 175/423 |
| 5,042,601 | A | * | 8/1991 | Penisson | 175/423 |
| 5,335,756 | A | | 8/1994 | Penisson | 188/67 |
| 6,155,748 | A | * | 12/2000 | Allen et al. | 405/195.1 |
| 6,192,981 | B1 | | 2/2001 | Boquet et al. | 166/75.13 |
| 6,948,575 | B1 | * | 9/2005 | Mosing et al. | 175/423 |
| 2003/0227187 | A1 | | 12/2003 | Bunn | 294/88 |

OTHER PUBLICATIONS

Article entitled "Pipe Handling Equipment Air-operated Power Slip" by Blohm & Voss Repair GmbH, Hamburg, Germany, dated Aug. 2003.

Article entitled "Access BackSaver" by Access Oil Tools, Broussard, LA.

* cited by examiner

*Primary Examiner*—David Bagnell
*Assistant Examiner*—Robert E Fuller
(74) *Attorney, Agent, or Firm*—Howrey LLP

(57) ABSTRACT

This invention relates to a mechanical apparatus for gripping and manipulating tubular members, such as drill pipe. The apparatus is essentially an automated slip puller, which generally comprises a slip base, a pulling mechanism pivotally attached to the slip base, and at least one cylinder or spring attached to the pulling mechanism. The entire apparatus is releasably connected to a rotary table located over a borehole. In a typical well drilling operation, the automated slip puller is attached to a slip assembly, which is thereafter placed around a drill pipe and positioned in the rotary table bushing. When the automated slip puller is activated, the pulling mechanism removes the slip assembly from the rotary table bushing and from around the drill pipe, thereby allowing the drill pipe to be manipulated in or out of the well bore. During operation, no portion of the automated slip puller is located outside the boundary of the rotary table.

30 Claims, 6 Drawing Sheets

POWER SLIP FOR DRILLPIPE

BACKGROUND OF THE INVENTION

The present invention relates generally to a slip-type apparatus for gripping and manipulating tubular members, such as drill pipe and bottom-hole assembly components. More specifically, the present invention relates to an automated apparatus for manipulating pipe members into and out of petroleum wells.

A typical slip-type apparatus generally comprises a plurality of circumferentially spaced slip bodies that can be placed around the locus of a drill pipe or other tubular member. The inner sides of the slip bodies carry gripping members, usually in the form of teeth, for frictionally engaging the drill pipe or tubular member. The outer sides of the slip bodies generally have tapered surfaces that are inclined inwardly from top to bottom.

In a typical well drilling operation, the slip-type apparatus is secured around the pipe member and placed in the portion of the rotary table referred to as the rotary table bushing or "bowl." Because the slip bodies can move both longitudinally and radially with respect to the bowl, these inclined surfaces serve as camming surfaces. Thus, when the weight of the pipe member is set down on the slip-type apparatus, so that it tends to move the slip bodies downwardly with respect to the bowl, the camming surfaces urge the slip bodies radially inwardly and into tighter engagement with the pipe member. Once set, the slips will support the weight of the drill pipe and/or other tubular members suspended therefrom.

In the past, such slip-type devices were manipulated manually by individuals working on the rig floor referred to as "roughnecks." The operation of securing the slip-type apparatus around the pipe member and in and out of the bowl presented a certain degree of danger to the roughnecks—accidents were commonplace. To alleviate this dangerous situation, automated "slip pullers" were developed. These devices essentially secured the slip-type device around the pipe member and in and out of the bowl without direct human intervention. While an improvement over the manual process, the automated slip puller did not eliminate risk entirely.

The automated slip pullers of the prior art were designed such that the devices were secured over the rotary table—usually via the drive or "kelly" bushings. Due to the unique operation of the prior art devices, the body of the slip pullers extended beyond the boundaries of the rotary table below. Such a prior art device is demonstrated, in FIGS. 1(*a-c*).

This design presented a potentially dangerous situation. If the rotary table began to spin with the automated slip puller attached, that portion of the device that extended beyond the boundary of the rotary table would spin as well, causing damage to any equipment, or injury to any individual, near the area. The present invention eliminates this potentially dangerous situation.

SUMMARY OF THE INVENTION

The present invention provides an automated slip pulling apparatus for manipulating tubular members, including drill pipe and drill collars. The preferred apparatus comprises a slip base, a pulling mechanism pivotally attached to the slip base, and at least one cylinder or spring attached to the pulling mechanism. The pulling mechanism generally comprises a top arm, at least one bottom arm, and a pull arm, all interconnected to the other components and the slip base.

Alternative embodiments may comprise additional components and/or multiple segments. The entire apparatus is releasably attached to a rotary table located over a borehole.

In a typical well drilling operation, the automated slip puller apparatus is attached to a slip assembly that is well known in the prior art. The slips are placed around a drill pipe and secured in the rotary table bushing. When the automated slip puller is activated, the pulling mechanism removes the slips from the rotary table bushing and from around the drill pipe, thereby allowing the drill pipe to be run into or out of the well bore. During operation, no portion of the automated slip puller is located outside the boundary of the rotary table. Because the entirety of the automated slip puller is located substantially within the boundaries of the rotary table, the present invention provides a safer working environment than did previous mechanical slip pullers.

Additional objects and advantages of the invention will become apparent as the following detailed description of the preferred embodiment is read in conjunction with the drawings which illustrate the preferred embodiment.

DESCRIPTION OF ILLUSTRATIVE EMBODIMENTS

Figure 1B:
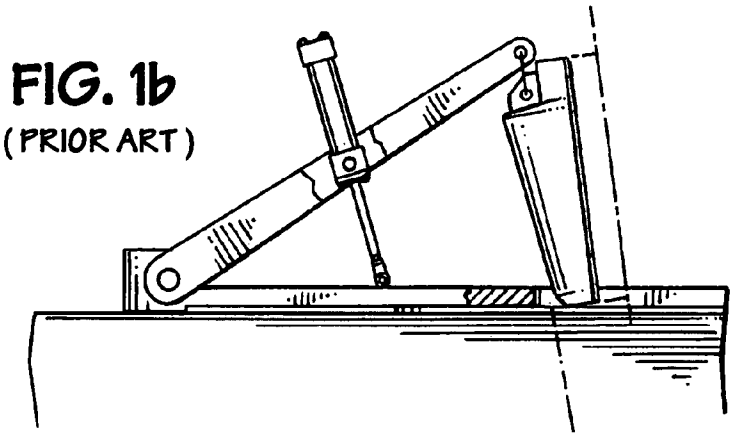
FIG. 1b (PRIOR ART)
FIGS. 1(*a-c*) do not represent the present invention but are presented to illustrate the prior art.
Figure 1A:
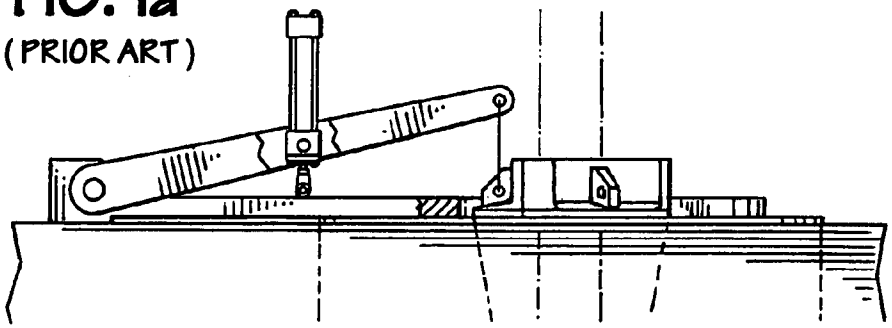
FIG. 1a (PRIOR ART)
Figure 1C:
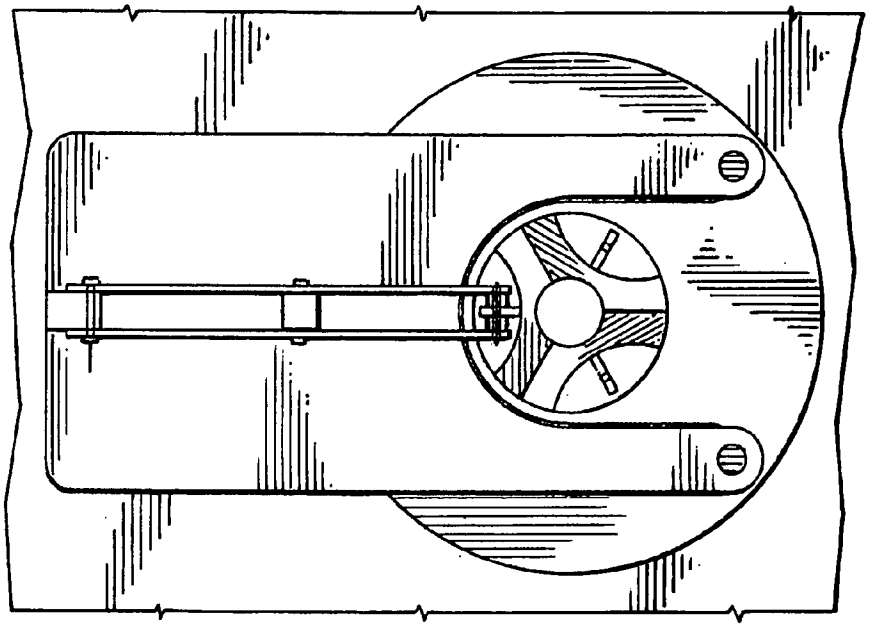
FIG. 1c (PRIOR ART)
Figure 2A:
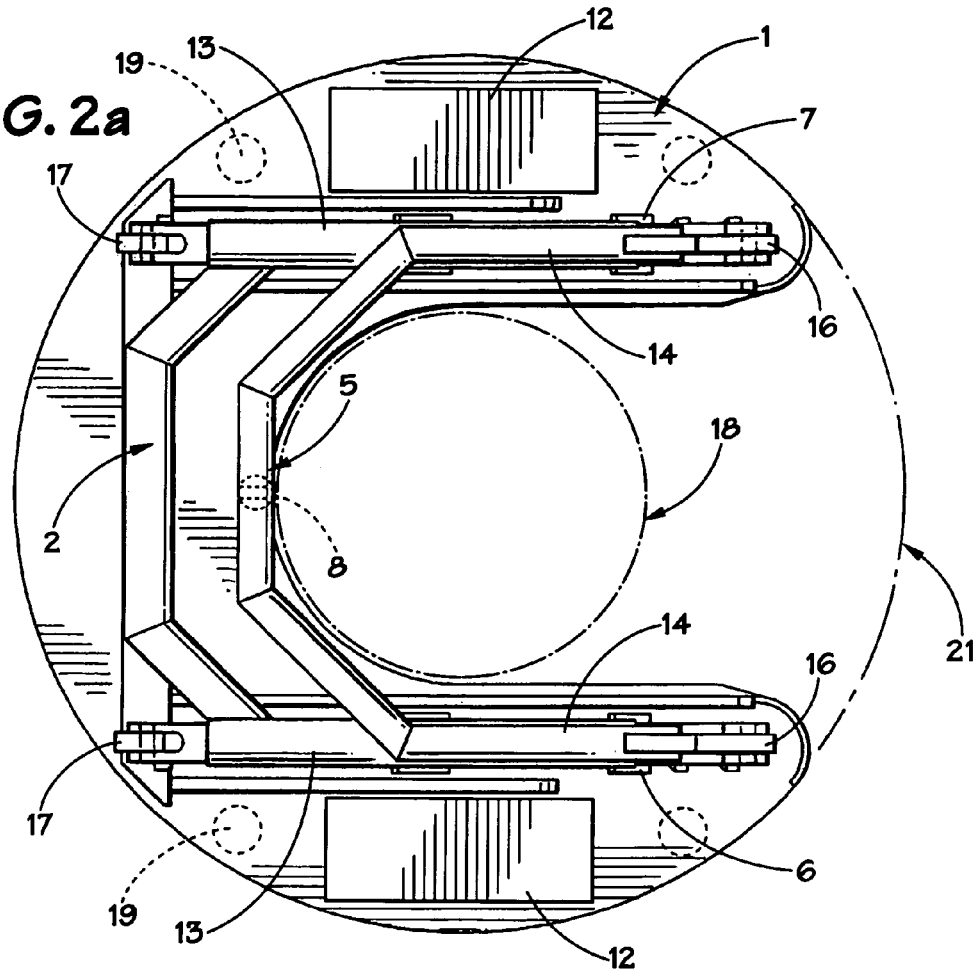
FIGS. 2(*a-b*) show top views of the automated slip puller assembly of the present invention.
Figure 2B:
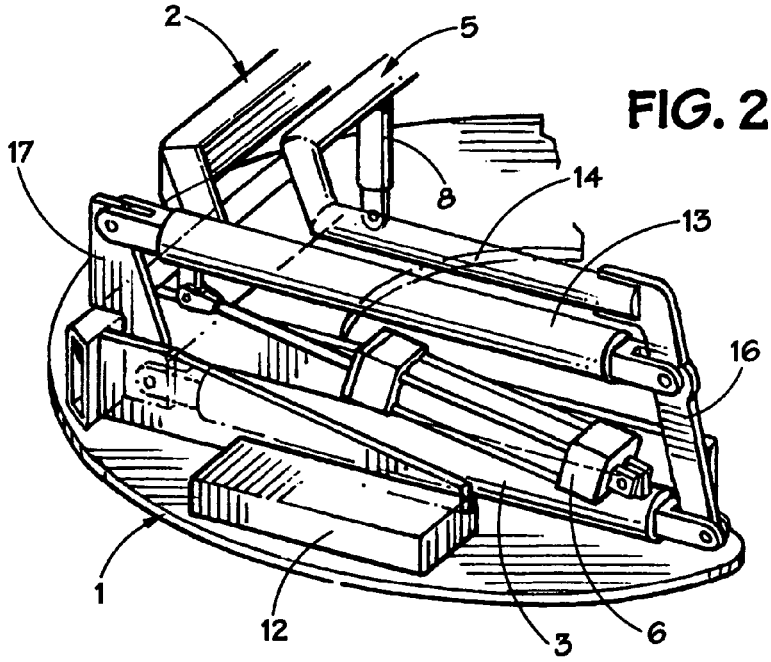

An automated slip puller assembly according to the present invention is shown generally at FIGS. 2(*a-b*) and 3. In a first embodiment, a slip base 1 is mounted on top of the rotary table 21 and may be secured thereto via pins (not shown) on the bottom of the slip base 1 that mate with the receptacles 19 in the rotary table 21 for the kelly bushing, or any other suitable means. In an alternative embodiment, the slip base 1 may contain magnets 12 that secure the slip puller to the rotary table 21 and eliminate any excessive vibration during operation. The magnets 12 may be utilized solely, or in conjunction with the pins previously described.

The slip base 1 is generally circular and contains a U-shaped cutout that allows for the rotary table bushing or bowl 18 to be exposed. The slip base 1 is otherwise substantially the same diameter as the rotary table 21. The slip base 1 also comprises a vertical extension 17 for connecting additional slip puller components. In the first embodiment, the slip base 1 effectively supports a top arm 2, two bottom arms 3 (only one is shown), a pull arm 5, and a pull arm extension 8. This combination of components is referred to generally as the pulling mechanism. The pulling mechanism is attached to the vertical extension 17 portion of the slip base 1.

The top arm 2 of the automated slip puller is generally U-shaped and effectively mirrors the U-shaped cutout of the slip base 1. The top arm is located above the bottom arms 3, below the pull arm 5, and is secured to the other components via pins or an effective equivalent. The top arm 2 may be formed by welding, molding, or any other suitable means. The bottom arms 3 are located directly under the top arm and run longitudinally and radially parallel to the limb portions 13 of the top arm 2. The bottom arms 3 are secured to the slip base 1 and other components via pins or an effective equivalent.

Two slip cylinders 6 and 7 are located between the limb portions 13 of the top arm 2 and the bottom arms 3, and connect the top arm 2 and bottom arms 3 via pins or an effective equivalent. The slip cylinders 6 and 7 run longitudinally and radially parallel to the limb portions 13 of the top arm 2 and the bottom arms 3. The slip cylinders can be hydraulic, pneumatic, or similar-type cylinders. The slip cylinders are preferably hydraulic cylinders due to the compact design of most commercially available hydraulic cylinders. Preferably, the hydraulic cylinders are activated by water.

Figure 4:
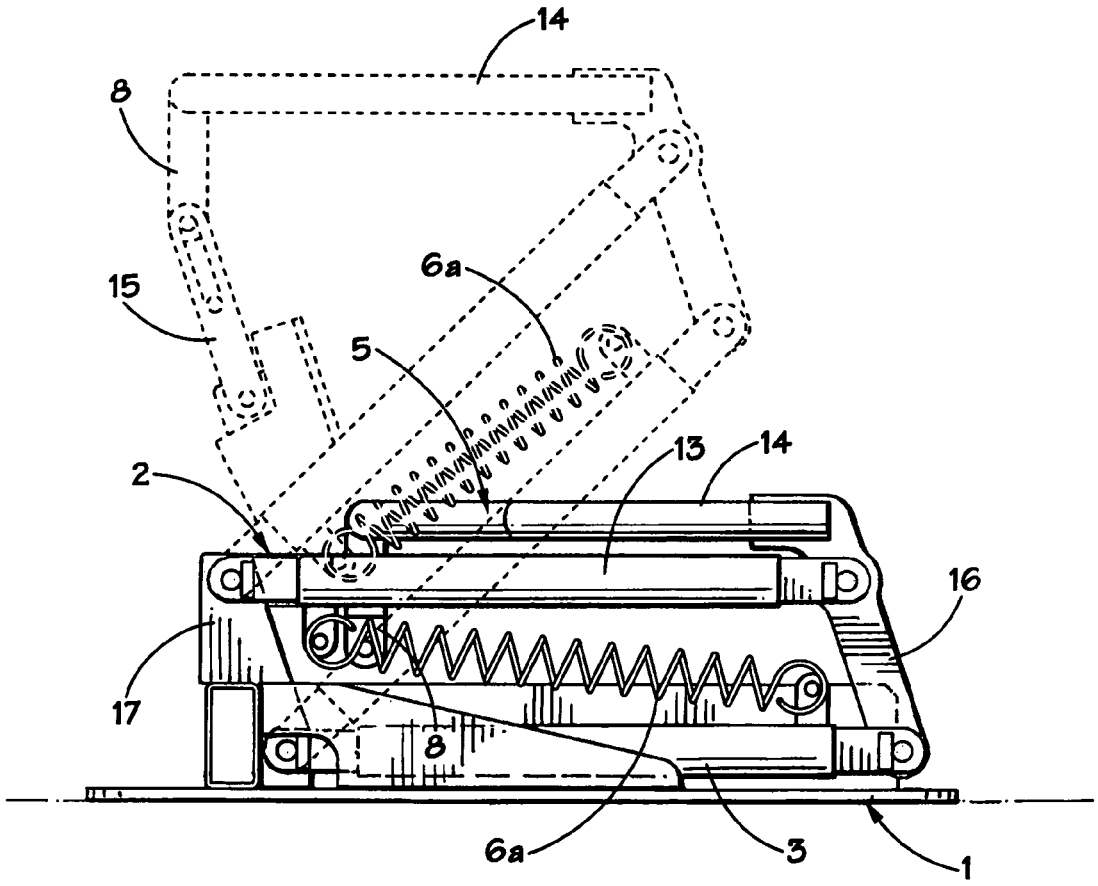
FIG. 4 shows a side view of an alternative embodiment of the automated slip puller assembly of the present invention.

In an alternative embodiment represented in FIG. 4, the slip cylinders 6 and 7 are replaced by two springs 6*a* (only one is shown in the view of FIG. 4). As with the slips cylinders 6 and 7, the springs 6*a* connect the top arm 2 and bottom arms 3 via pins or an effective equivalent and run longitudinally and radially parallel to the limb portions 13 of the top 2 and the bottom arms 3.

Figure 3:
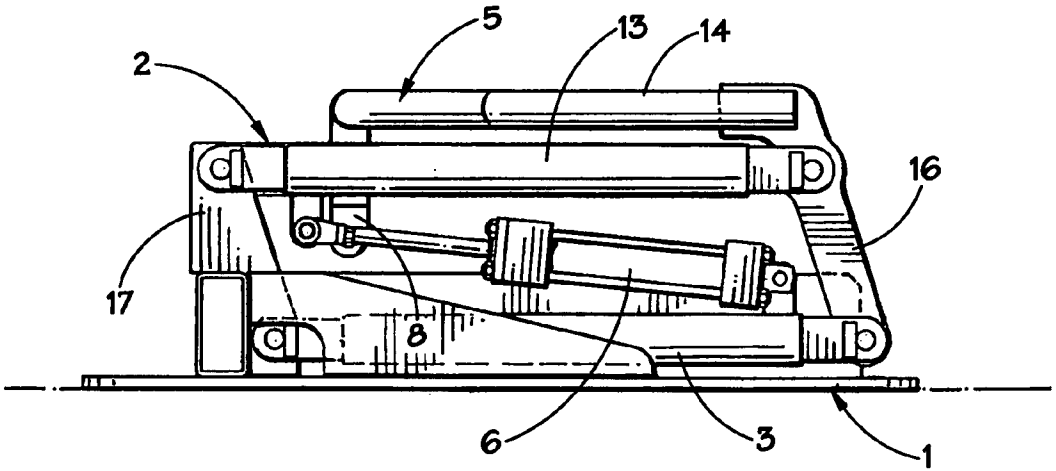
FIG. 3 shows a side view of the automated slip puller assembly of the present invention.

Returning to FIGS. 2 and 3, the pull arm 5 is located at the top of the automated slip puller, above the top arm 2. Similar to the top arm 2, the pull arm 5 is effectively U-shaped. However, in the preferred embodiment, the base of the "U" is located closer to the cutout portion of the slip base 1 when viewing the automated slip puller from above. The limbs 14 of the pull arm 5 run longitudinally and radially parallel to the limbs 13 of the top arm 2 and bottom arms 3, except for the connective portion 16 located at the end of the limbs 14. This portion of the pull arm 5 is directed downward towards the slip base 1 and connects the bottoms arms 3 and top arm 2 to the pull arm 5.

At the base of the "U" portion of the pull arm 5, is the pull arm extension 8. The pull arm extension 8 extends downward from the pull arm 5 and connects the pull arm 5 to an accommodating link 15 (shown in FIG. 4). The accommodating link 15, in turn, connects the pull arm extension 8 to the slips 9. The accommodating link 15 is preferably arranged in a configuration that allows for a certain freedom of movement—such as a chain link or slotted link configuration. This type of configuration allows for varying sizes of slips 9 to rest within the rotary table bushing when placed around a drill pipe or other tubular member. This, in turn, avoids placing any strain on the automated slip puller from the weight of the tubular member.

Figure 5A:
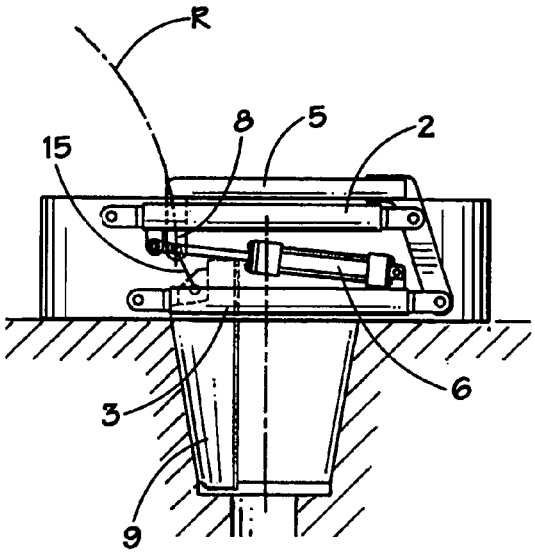
FIGS. 5(*a-d*) show the operation of the automated slip puller assembly of the present invention from the side view.
Figure 5B:
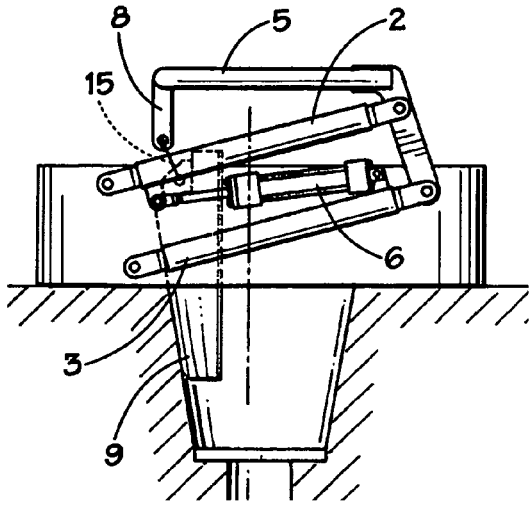
Figure 5C:
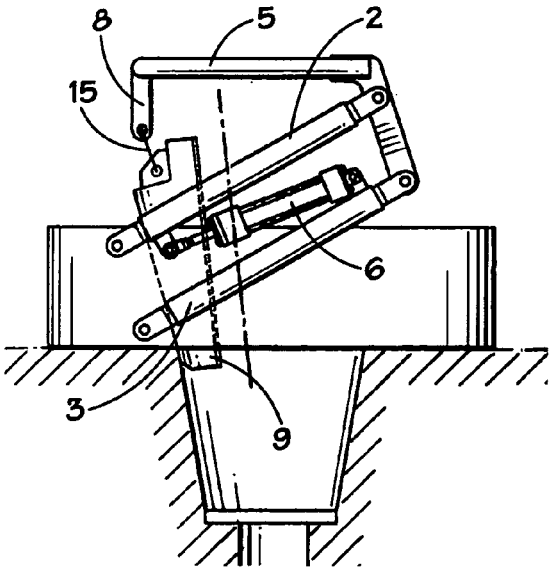

Referring now to FIGS. 5*a* through 5*d*, a preferred embodiment of the present invention is shown in operation. Referring specifically to FIG. 5*a*, a slip cylinder 6 is shown in an extended position. This position of the slip cylinder 6 places the slips 9 within the rotary table bushing or bowl. This position is referred to as the "deactivated" position. FIGS. 5*b* and 5*c* demonstrate the movement of the slip puller as the slip cylinder 6 is being manipulated into a retracted position and the slips 9 are removed from the bowl and from around a tubular member such as drill pipe (not shown). As the figures demonstrate, the bottoms arms 3 and top arm 2 are manipulated effectively upward by the slip cylinder 6. As these members are manipulated, the bottom arms 3 and the limbs of the top arm 2 remain substantially parallel to each other and effectively form a parallelogram. In contrast, the pull arm 5 remains substantially parallel to the slip base 1.

Figure 5D:
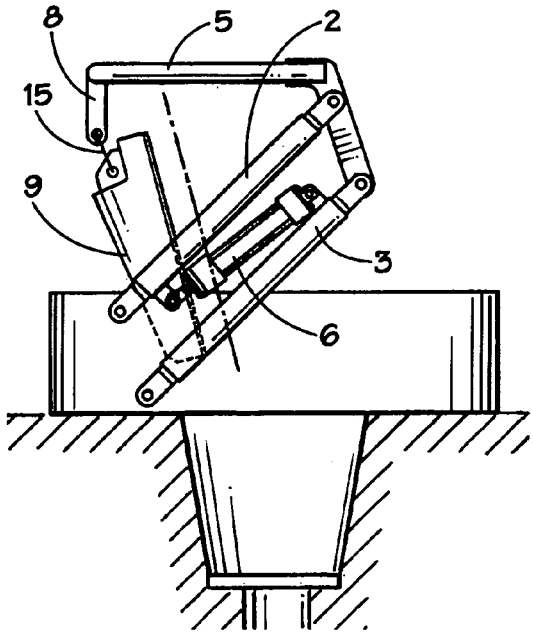

FIG. 5*d* shows the slip cylinder 6 in the fully retracted position and the slips 9 completely removed from the bowl and drill pipe. This position is referred to as the "activated" position. In this position, the bottom arm 3 and the limbs of the top arm 2 are still substantially parallel to each other (again effectively exhibiting a parallelogram geometry), while the pull arm 5 is substantially parallel to the slip base 1. The pulling radius R of the pull arm 5 is shown in FIG. 5*a*. As the automated slip puller is manipulated from the deactivated to the activated position, it is apparent from FIGS. 5(*a-d*) that substantially no portion of the apparatus extends beyond the boundaries of the rotary table.

In one embodiment of the invention described above, the slip cylinders 6 and 7 of the automated slip puller are operated remotely from the drill floor via a pedal. Alternatively, the slip cylinders 6 and 7 of the automated slip puller may be operated from the driller's control panel or another suitable location.

In an alternative embodiment of the invention as shown in FIG. 4, the automated slip puller is substantially the same as described above, but is manipulated between the activated and deactivated position by one or more springs 6*a* (only one is shown in FIG. 4). The spring is biased in an extended position, which results in the automated slip puller being biased in the activated position as shown in FIG. 4. When the slips 9 are thereafter placed around a tubular member, the weight of the tubular member overcomes the natural bias of the springs 6*a* and places the slips 9 within the rotary table bushing or bowl. Once the tubular member is lifted from the bowl, the bias of the springs 6*a* manipulates the automated slip puller back to the activated position and removes the slips 9 from within the bowl.

Figure 6B:
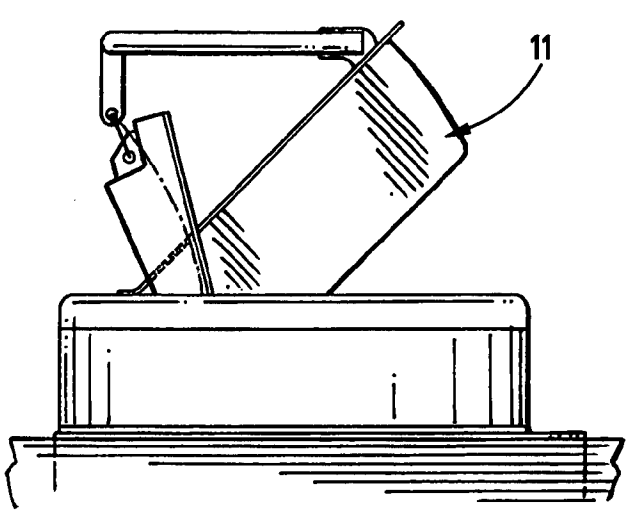
FIGS. 6(*a-c*) show the automated slip puller assembly of the present invention encased in a protective sheath.
Figure 6A:
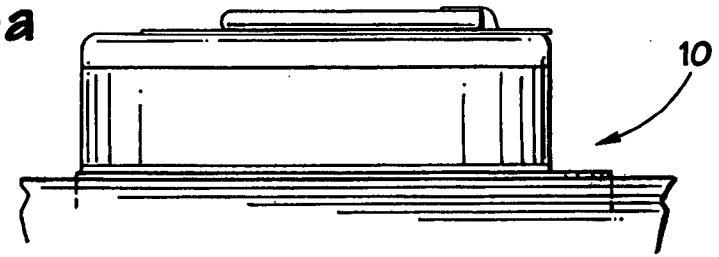
Figure 6C:
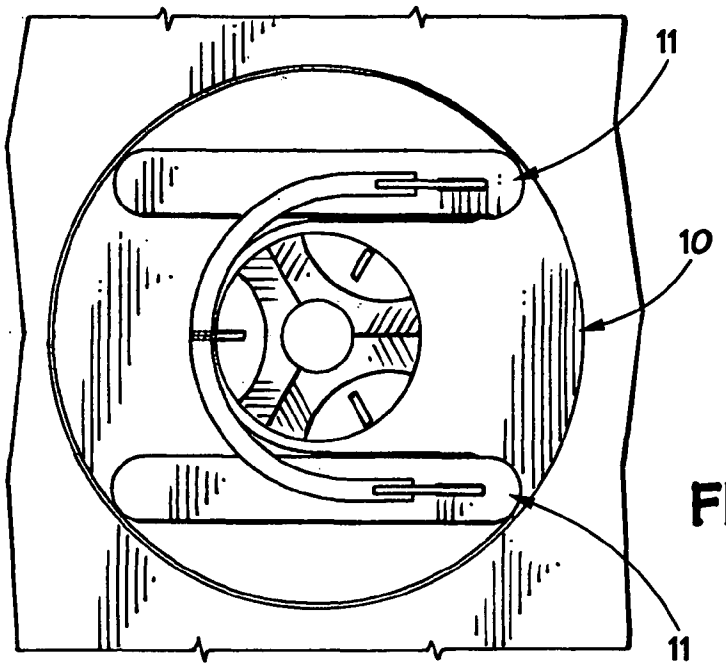

FIGS. 6*a* and 6*c* show the automated slip puller of the present invention covered by a protective sheath 10 formed of stainless steel, plastic, rubber, or other suitable material. When in the deactivated position, the protective sheath 10 protects the components of the slip puller from exposure to drilling fluids or other hazardous and/or corrosive materials that accompany typical well drilling operations. FIG. 6*b* shows the automated slip puller in the activated position. A protective cover 11 shields the bottom arms, the top arm, and the slip cylinders from drilling fluids and the like. The protective cover 11 may be separate from the protective sheath 10 or an integral part thereof.

Figure 7:
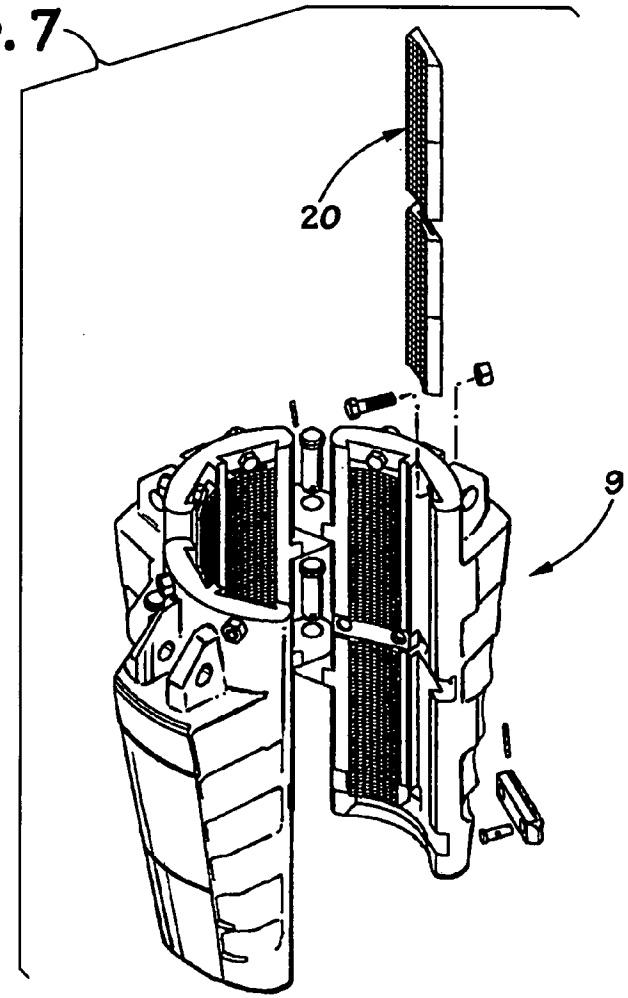
FIG. 7 shows an exploded view of a slip assembly used in conjunction with the present invention.

Referring now to FIG. 7, a standard set of slips 9 is shown in exploded detail. The slips 9 comprise three separate slip segments with hinges connecting the three components together. On the interior portion of the slip components are located teeth 20 for frictionally engaging drill pipe or other tubular members. This configuration has been in use for several years and is well known in the prior art.

The slip configuration shown in FIG. 7 is readily transformable from a manual slip type to one compatible with the automated slip puller of the present invention. The handles (not shown) for the slips 9 are removed and the slips 9 are suspended from the pull arm extension 8 by connecting the accommodating link 15 to a suitable attachment point on the central slip segment of the slips 9 (as shown in FIGS. 5(*a-d*)).

While preferred embodiments of the apparatus have been discussed for the purposes of this disclosure, numerous changes in the arrangement and construction of the automated slip puller may be made by those skilled in the art. All such changes are encompassed within the scope and spirit of the following claims.

What is claimed is:

1. An automated slip puller apparatus comprising:

a slip base located on a rotary table, wherein no portion of the slip base is outside of the boundary of the rotary table;

a pulling mechanism pivotally attached to the slip base, the pulling mechanism comprising at least one bottom arm and a top arm, wherein the at least one bottom arm and the top arm exhibit a parallelogram geometry, the pulling mechanism further comprising a pull arm connected to the at least one bottom arm and the top arm;

slips connected to the pulling mechanism; and at least one cylinder connected to the pulling mechanism and operable to move the pulling mechanism between an activated and a deactivated position, wherein no portion of the at least one cylinder or pulling mechanism is outside of the boundary of the rotary table.

2. The automated slip puller apparatus of claim 1, wherein the slip base is connected to the rotary table via Kelley bushing receptacles.

3. The automated slip puller apparatus of claim 1, wherein the slip base is connected to the rotary table via magnets.

4. The automated slip puller apparatus of claim 1, wherein the cylinder comprises a hydraulic cylinder.

5. The automated slip puller apparatus of claim 1, wherein the cylinder comprises a pneumatic cylinder.

6. The automated slip puller apparatus of claim 1, wherein the pulling mechanism further comprises a pull arm extension connected to the pull arm.

7. The automated slip puller apparatus of claim 6, wherein the slips are suspended from an accommodating link connected to the pull arm extension.

8. The automated slip puller apparatus of claim 1, wherein the at least one bottom arm and the top arm exhibit a parallelogram geometry both in the activated and deactivated position.

9. The automated slip puller apparatus of claim 1, wherein the pulling mechanism is encased in a protective sheath.

10. The automated slip puller apparatus of claim 1, wherein the apparatus is manipulated via remote control.

11. The automated slip puller apparatus of claim 1, wherein no portion of the automated slip puller is outside the boundary of the rotary table when in the activated position.

12. An apparatus for manipulating tubular members comprising:

a slip base attached to a rotary table, wherein no portion of the slip base is outside of the boundary of the rotary table;

gripping means for engaging the tubular members, manipulating means for moving the gripping means between an activated and deactivated position, wherein no portion of the manipulating means is outside of the boundary of the rotary table; and connecting means, attached to the slip base, for connecting the gripping means to the manipulating means, the connecting means comprising at least one bottom arm and a top arm, wherein the at least one bottom arm and the top arm exhibit a parallelogram geometry, the connecting means further comprising a pull arm connected to the at least one bottom arm and the top arm.

13. The apparatus of claim 12, wherein the slip base is attached to the rotary table via the Kelley bushing receptacles.

14. The apparatus of claim 12, wherein the slip base is connected to the rotary table via magnets.

15. The apparatus of claim 12, wherein the connecting means exhibits a parallelogram geometry both in the activated and deactivated position.

16. The apparatus of claim 12, wherein the connecting means and manipulating means are encased in a protective sheath.

17. The apparatus of claim 12, wherein the apparatus is manipulated via remote control.

18. The apparatus of claim 12, wherein the connecting means further comprises a pull arm extension connected to the pull arm.

19. The apparatus of claim 18, wherein the slips are suspended from an accommodating link connected to the pull arm extension.

20. A method of operating a power slip apparatus comprising the steps of:

constructing a power slip apparatus comprising at least:

a slip base located on a rotary table, wherein no portion of the slip base is outside of the boundary of the rotary table;

a pulling mechanism pivotally attached to the slip base, comprising at least one bottom arm and a top arm, wherein the at least one bottom arm and the top arm exhibit a parallelogram geometry, the pulling mechanism further comprising a pull arm connected to the at least one bottom arm and the top arm;

slips connected to the pulling mechanism; and manipulating the pulling mechanism by means of a cylinder between an activated and a deactivated position, wherein no portion of the pulling mechanism and no portion of the cylinder is outside of the boundary of the rotary table.

21. The method of claim 20, wherein the cylinder comprises a hydraulic cylinder.

22. The method of claim 20, wherein the cylinder comprises a pneumatic cylinder.

23. The method of claim 20, wherein the pulling mechanism is manipulated via remote control.

24. The method of claim 20, wherein the pulling mechanism exhibits a parallelogram geometry both in the activated and deactivated position.

25. The method of claim 20, wherein no portion of the power slip apparatus is outside the boundary of the rotary table when in an activated position.

26. The apparatus of claim 20, wherein the pulling mechanism further comprises a pull arm extension connected to the pull arm.

27. An automated slip puller apparatus comprising:

a slip base located on a rotary table, wherein no portion of the slip base is outside of the boundary of the rotary table;

a pulling mechanism pivotally attached to the slip base, the pulling mechanism comprising at least one bottom arm and a top arm, wherein the at least one bottom arm and the top arm exhibit a parallelogram geometry, the pulling mechanism further comprising a pull arm connected to the at least one bottom arm and the top arm;

slips connected to the pulling mechanism; and one or more springs connected to the pulling mechanism and operable to move the pulling mechanism between an activated and a deactivated position, wherein no portion of the one or more springs and no portion of the pulling mechanism is outside of the boundary of the rotary table.

28. The automated slip puller apparatus of claim 27, wherein the pulling mechanism further comprises a pull arm extension connected to the pull arm.

29. The automated slip puller apparatus of claim 28, wherein the slips are suspended from an accommodating link connected to the pull arm extension.

30. The apparatus of claim 26, wherein the slips are suspended from an accommodating link connected to the pull arm extension.

* * * * *